US009140084B2

(12) United States Patent
Laplante

(10) Patent No.: US 9,140,084 B2
(45) Date of Patent: Sep. 22, 2015

(54) LOCKING DEVICE FOR A DRILLING DEVICE

(75) Inventor: Raymond Laplante, Val d'Or (CA)

(73) Assignee: LES ENTREPRISES PARLEC LTÉE, Val d'Or, Quebec (CA)

( * ) Notice: Subject to any disclaimer, the term of this patent is extended or adjusted under 35 U.S.C. 154(b) by 802 days.

(21) Appl. No.: 13/263,469

(22) PCT Filed: Apr. 8, 2010

(86) PCT No.: PCT/CA2010/000533

§ 371 (c)(1),
(2), (4) Date: Dec. 14, 2011

(87) PCT Pub. No.: WO2010/115284

PCT Pub. Date: Oct. 14, 2010

(65) Prior Publication Data

US 2012/0090894 A1 Apr. 19, 2012

(30) Foreign Application Priority Data

Apr. 9, 2009 (CA) ..... 2673317

(51) Int. Cl.
*E21B 25/02* (2006.01)
*E21B 23/02* (2006.01)

(52) U.S. Cl.
CPC ..... *E21B 23/02* (2013.01); *E21B 25/02* (2013.01)

(58) Field of Classification Search
CPC ..... E21B 25/02; E21B 25/04; E21B 23/01; E21B 23/02
USPC ..... 175/57, 230, 246, 249, 236
See application file for complete search history.

(56) References Cited

U.S. PATENT DOCUMENTS

| | | | | |
|---|---|---|---|---|
| 473,908 | A | 5/1892 | Bullock | |
| 3,120,282 | A * | 2/1964 | Pickard | 175/214 |
| 3,333,647 | A * | 8/1967 | Karich et al. | 175/247 |
| 3,951,219 | A | 4/1976 | Cortes | |
| 4,466,497 | A * | 8/1984 | Soinski et al. | 175/246 |

(Continued)

FOREIGN PATENT DOCUMENTS

| | | |
|---|---|---|
| CA | 2 370 918 | 8/2002 |
| EP | 0 325 835 | 8/1989 |

OTHER PUBLICATIONS

International Search Report for International Application No. PCT/CA2010/000533 mailed Jul. 12, 2010.

*Primary Examiner* — Shane Bomar
*Assistant Examiner* — David Carroll
(74) *Attorney, Agent, or Firm* — Pearl Cohen Zedek Latzer Baratz LLP

(57) ABSTRACT

Latching device for a drilling device comprising a latching body mountable in an outer tube, an unlatching tube slidably mountable around the latching body, two latches attached to the latching body and pivotable between a deployed position in which the latch cooperates with the outer tube in order to latch the latching body to said outer tube and a retracted position for unlatching the latching body from the outer tube, a piston sliding around the latching body and secured to the unlatching tube, and a compression spring mechanism pressing the piston towards the latches in order to maintain the latches in their deployed position, a pulling force exerted on the unlatching tube compressing the spring mechanism to prevent the piston from pressing against the latches which position themselves in their retracted position.

17 Claims, 1 Drawing Sheet

(56) References Cited

U.S. PATENT DOCUMENTS 5,339,915 A 8/1994 Laporte et al.
5,799,742 A * 9/1998 Soinski et al. ..... 175/236
5,992,543 A * 11/1999 Soinski et al. ..... 175/58
6,029,758 A * 2/2000 Novacovicci et al. ..... 175/234
6,425,449 B1 * 7/2002 Marshall ..... 175/236
2008/0246273 A1 10/2008 Anderson

* cited by examiner

LOCKING DEVICE FOR A DRILLING DEVICE

CROSS-REFERENCE TO RELATED APPLICATIONS

This application is a National Phase Application of PCT International Application No. PCT/CA2010/000533, entitled "LOCKING DEVICE FOR A DRILLING DEVICE", International Filing Date Apr. 8, 2010, published on Oct. 14, 2010 as International Publication No. WO 2010/115284, which in turn claims priority from Canadian Patent Application No. 2,673,317, filed Apr. 9, 2009, both of which are incorporated herein by reference in their entirety.

FIELD OF THE INVENTION

The present invention generally concerns a latching method and a latching device for a drilling device, and more particularly a latching device for latching a core barrel onto an outer tube buried in a borehole.

PRIOR ART

In a typical drilling operation, the driller starts by introducing a tube in the ground. The drilling itself will then be performed inside the tube.

Wire line core barrels are double tube core barrels in which the inner tube, which receives the core, can be hoisted to the surface through the drill string, with the help of an overshot connected to a cable, while the outer tube of the core barrel remains into the drilled hole.

In order to obtain samples at the bottom of a borehole, the driller, during the drilling operation, must use a core barrel to get rock samples. When the driller wishes to hoist up the core, a core tube is placed inside the drill pipe and then dropped into the borehole until it reaches the part above of the rotating core tube.

Mainly, two types of latching system for core barrels are available, that is systems with spring latches and systems with link latches.

Spring latches are devices which are satisfactory for drillings from the surface, but they can prove to be dangerous underground because the springs do not always have the necessary strength to maintain the pin in place. The pin can therefore slip and disengage itself, thereby releasing the core barrel. This undesirable phenomenon can for example happen in the presence of a backflow in the hole. The latches can therefore retract without warning and release the core barrel. This can cause serious injuries when, at the bottom of the mine, the driller drills upwards while standing in front of the borehole because nothing prevents the mass of the core barrel from crashing upon the driller at full speed.

Similar devices are described in several patents, including US patent application 2008/246273 of Shelljet Pty Ltd, or U.S. Pat. No. 5,339,915 of JKS Boyles International Inc.

Link latches form a complicated device that requires a lot of maintenance because of the frequent breakage of the small spring which, when in operation, only abuts small uneven surfaces. Moreover, this device requires a great travel distance for the retraction of the latches, making it difficult to unlatch once underground.

Similar devices are described in several patents, including U.S. Pat. No. 6,425,449 of Boart Longyear Internet Holding.

It is however known to use gravity amplified by a spring to latch the latches, as for example described in European patent 0325835 of Eastern Oil Tools Pte Ltd entitled <<Mechanical latching device operated by dead weight and tension>>.

However, in the device described in this patent, the spring does not interact directly with the piston and therefore does not act on the latching. Moreover, in order to function, the housing must abut the latches. The latches are therefore in the unlatched position, thereby preventing any drilling operations, during which it is essential that the latches be in the latched position.

There is therefore a need for a latching device without at least one of the drawbacks of the prior art latching devices.

SUMMARY

An object of the invention is to provide a latching device which overcomes at least one of the drawbacks of the prior art latching devices described above.

According to this object, the invention proposes a latching device for a drilling device comprising an outer tube provided with an internal shoulder. The latching device comprises an elongated latching body comprising a lower portion mountable in the outer tube and an elongated upper portion; an unlatching tube mountable in the outer tube around the latching body and slidable between a high operating position and a low rest position, said unlatching tube comprising at least two elongated lateral openings distributed therearound; at least two latches, each latch being pivotably mounted on the latching body and comprising an operative end, each latch being pivotable between a deployed position wherein the operative end of the latch projects outside the unlatching tube through one of the corresponding openings to abut under the internal shoulder of the outer tube in order to latch the latching body to the outer tube and prevent its removal and a retracted position wherein the latch is retracted near the latching body in order to unlatch the latching body from the outer tube; a tubular piston slidably mounted around the latching body proximal to the operative ends of the latches and secured to the unlatching tube; and a compression spring mechanism mounted on the upper portion of the latching body and pressing the piston towards the latches to maintain the latches in the deployed position in order to allow a drilling operation, wherein a pulling force exerted on the unlatching tube secured to the piston compresses the spring mechanism so as to prevent the piston from pushing against the latches which move in their retracted position in order to allow an element to be hoisted up from the drilling device.

Throughout the following description, the term mountable should be interpreted as meaning able to be mounted, which can be assembled by mounting.

The latching device allows drilling operations in the latched position and the retrieval of a sample core in the unlatched position, which is a great advantage.

In addition, the drilling device improves the driller's safety and the reliability of the drilling operations, which is a great advantage.

Moreover, the latching device can be manufactured in a less expensive way, which is a great advantage.

According to one aspect of the invention, the latching device can be used in boreholes oriented downwards or upwards, which is a great advantage.

In an embodiment, each opening has a predetermined width for snuggly receiving the operative end of a corresponding latch.

In another embodiment, the outer tube comprises a tubular element designed to be buried in a borehole, an adaptor sleeve mounted of the tubular element and a locking sleeve mounted on the adaptor sleeve.

In an embodiment, the internal shoulder is defined by an end of the locking sleeve extending inside the adaptor sleeve.

In an embodiment, each latch comprises an inner contact surface having a predetermined shape complementary to a corresponding lateral outer surface of the piston when the latches extend in their deployed position.

In an embodiment, the inner contact surface of the operative end of each latch comprises at least two portions extending at an angle comprised between 20 and 60 degrees with respect to a longitudinal axis of the outer tube when the latches extend in their deployed position.

In an embodiment, the at least two portions extend at a 30 degree angle with respect to the longitudinal axis of the outer tube when the latches extend in the deployed position.

In an embodiment, the operative end of each latch comprises an upper stop surface having a predetermined shape complementary to a corresponding stop surface of the internal shoulder when the latches extend in the deployed position.

In an embodiment, each stop surface of the internal shoulder comprises a planar surface perpendicular to a longitudinal axis of the outer tube.

In an embodiment, the operative end of each latch comprises a lateral outer contact surface having a predetermined shape complementary to a corresponding lateral outer surface of the outer tube when the latches extend in the deployed position.

In an embodiment, the lateral outer contact surface of the operative end of each latch and each corresponding lateral outer surface of the outer tube comprise a cylindrical portion.

In an embodiment, the operative end of each latch comprises a lower lateral outer surface extending at a predetermined angle with respect to the unlatching tube when the latches extend in the deployed position, the unlatching tube pushing each latch in its retracted position by sliding in its high operating position against the lower lateral outer surface of the operative end of the corresponding latch.

In an embodiment, the predetermined angle of each lower lateral outer surface is comprised between 15 and 30 degrees.

In an embodiment, the predetermined angle is 23 degrees.

In an embodiment, the unlatching tube comprises a lower end abutting against the lower portion of the latching body when the tube extends in its low rest position.

In an embodiment, the device further comprises a split pin for securing the piston to the unlatching tube.

In an embodiment, the device further comprises a gripping head mounted in the unlatching tube proximate an access opening of the outer tube for pulling the unlatching tube in its high operating position and releasing the latches.

In an embodiment, the spring mechanism comprises a spring mounted around the upper portion of the latching body, a retaining washer and a retaining nut mounted longitudinally relative to the latching body for keeping the spring in compression against the piston.

In an embodiment, the spring is compressed between 10% and 25% when the unlatching tube extends in the low rest position.

In an embodiment, the spring is compressed by 17% when the unlatching tube extends in the low rest position.

In an embodiment, each latch is attached to the latching body using a split pin.

In an embodiment, the latching body is retained in the outer tube via a stop shoulder and of a suspension bushing mounted in the outer tube.

In an embodiment, the element hoisted from the drilling device comprises a core barrel which allows a core to be obtained.

In an embodiment, the piston and each latch comprise a heat-treated steel.

In an embodiment, the piston and each latch comprise an alloyed steel.

In an embodiment, the piston and each latch comprise a hardened steel.

In an embodiment, the latching device is used for allowing a drilling operation when the device is latched, and for allowing hoisting up a core obtained during the drilling operation when the device is unlatched.

In an embodiment, the latching device is used in mining boreholes.

In an embodiment, the latching device is used in oil wells.

Another object of the invention is to provide a drilling method for a drilling well, the method comprising installing a drilling apparatus provided with an outer tube at a location where the borehole is to be drilled; providing a latching device; attaching a drilling head to a lower end of the latching device; lowering the drilling head into the outer tube; latching the latching device inside the outer tube; and drilling the borehole using the drilling head.

In an embodiment, the method further comprises using a core barrel to obtain a sample core; exerting a pulling force on the unlatching tube of the latching device to unlatch the latching device from the outer tube; and hoisting up the sample core.

In an embodiment, the pulling force exerted on the unlatching tube of the latching device is exerted using gripping means.

BRIEF DESCRIPTION OF THE FIGURES

The present invention and all its advantages will be better understood upon reading the following non-limitative specification with reference to the drawings, in which the same numeric references identify the same elements, and wherein.

DETAILED DESCRIPTION

The invention relates to ground drilling tools, and more particularly concerns a latching device with latches for core barrels.

As detailed hereinbelow, the latching device allows not only to latch a tool at the bottom of a borehole during drilling operations, but also to help hoisting up rock samples, also known as cores.

Figure 1:
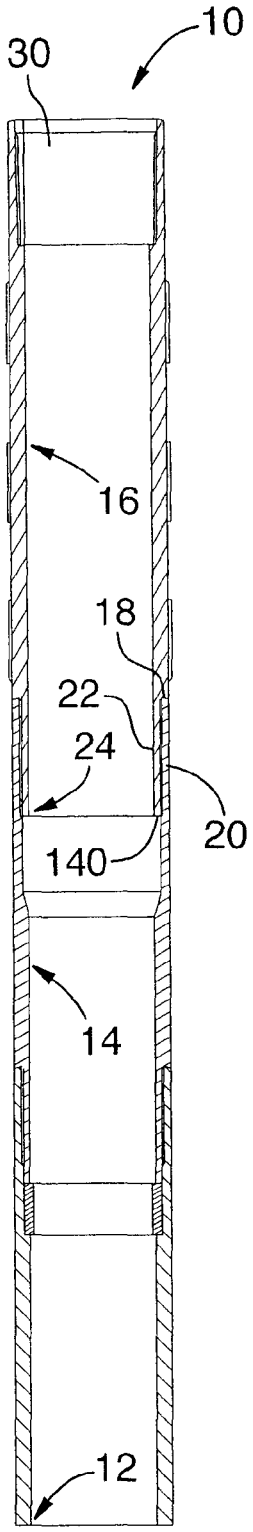
FIG. 1 is a longitudinal sectional view of an outer tube of a drilling device.

FIG. 1 shows an outer tube 10 of a drilling device (not shown) used during the drilling of a borehole (not shown), such as a mining borehole or an oil well. In the illustrated embodiment, the outer tube 10 comprises a tubular element 12 designed to be buried in the borehole and through which the drilling will be performed, an adaptor sleeve 14 mounted on the tubular element 12 and a locking sleeve 16 mounted on the adaptor sleeve 14. In a preferred embodiment, the adaptor sleeve 14 is screwed onto the tubular element 12 and the locking sleeve 16 is screwed onto the adaptor sleeve 14. The person skilled in the art of the invention will appreciate that other arrangements may be considered.

As illustrated, the locking sleeve 16 comprises a shoulder 18 on its outer surface upon which the corresponding end 20 of the adaptor sleeve 14 abuts. The corresponding end 22 of the locking sleeve 16 extends inside the adaptor sleeve 14 and its section surface defines an internal shoulder 24 inside the outer tube 10.

Figure 2:
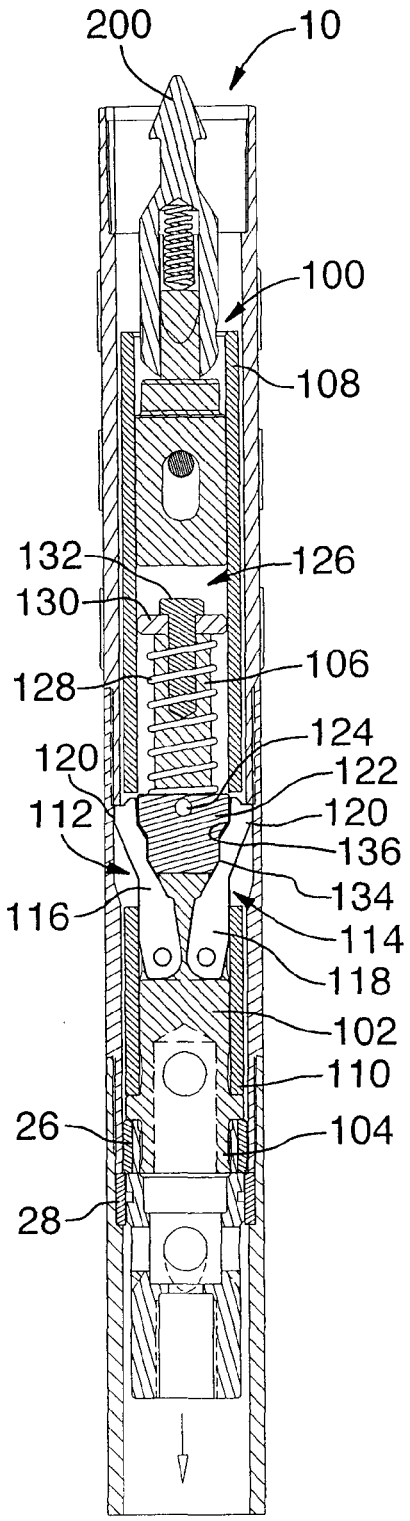
FIG. 2 is a longitudinal sectional view of a drilling head comprising a latching device mounted in the outer tube of FIG. 1, in which the latches of the latching device are in the deployed position, the drilling head being latched to the outer tube.

FIG. 2 shows a drilling head comprising a latching device 100, the drilling head being mounted inside the outer tube 10 shown in FIG. 1.

The latching device 100 comprises an elongated latching body 102 which comprises a lower portion 104 which can be mounted in the outer tube 10 and an elongated upper portion 106. In the illustrated embodiment, the latching body 102 is retained in the outer tube 10 by means of a stop shoulder 26 and of a suspension bushing 28 mounted inside the outer tube 10, as is well known in the field of the invention. The person skilled in the art of the invention will however appreciate that arrangements other than the one shown could also be used to retain or seat the latching body 102 inside the outer tube 10.

The latching device 100 also comprises an unlatching tube 108 mountable inside the outer tube 10 around the latching body 102 and slidable between a high operating position, as detailed hereinbelow with reference to FIG. 3, and a low rest position, as shown in FIG. 2.

In an embodiment, as shown in FIG. 2, the unlatching tube 108 comprises a lower end 110 abutting the lower part 104 of the latching body 102 when the tube 108 extends in its low rest position. The person skilled in the art will appreciate that other embodiments may be considered.

The unlatching tube 108, in the illustrated embodiment, comprises two elongated lateral openings 112, 114 distributed along the periphery of the tube 108, as detailed hereinbelow.

The illustrated latching device 100 comprises two latches 116, 118, each one being pivotally attached to the latching body 102 and comprising an operative end 120. Each latch 116, 118 is pivotable between a deployed position, as shown in FIG. 2, and a retracted position, as shown in FIG. 3.

In an embodiment, each latch 116, 118 is attached to the latching body 102 with a split pin (not shown) but any other attaching means providing a hinged attachment could be used.

As shown in FIG. 2, when the latch 116 or 118 extends in the deployed position, its operative end 120 projects outside the unlatching tube 108 by one of its corresponding openings 112, 114 to abut under the internal shoulder 24 of the outer tube 10 in order to latch the latching body 102 to the outer tube 10 and prevent its unwanted release.

In an embodiment, each lateral opening 112, 114 distributed along the periphery of the tube has a predetermined width to snuggly receive the operative end 120 of the corresponding latch 116, 118. This characteristic may help the latches to stay in place even if they are subjected to important torsional forces. However, other embodiments may be considered.

Figure 3:
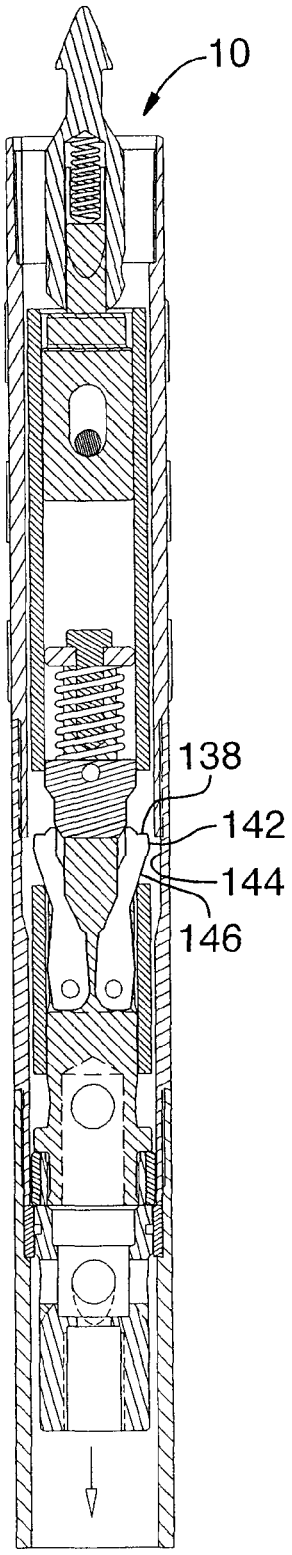
FIG. 3 is another longitudinal sectional view of the drilling head of FIG. 2, in which the latches of the latching device are in retracted position, the drilling head being unlatched from the outer tube.

As shown in FIG. 3, in the retracted position, the latch 116, 118 is retracted close to the latching body 102 to unlatch the latching body 102 from the outer tube 10. In other words, since the operative ends 120 of the latches 116, 118 do not abut under the internal shoulder 24 of the outer tube 10 anymore, they do not prevent the release of the latching body 102 from the outer tube 10.

In the illustrated embodiment, the latching device 100 is provided with two latches 116, 118 mounted in a diametrically opposed configuration around the latching body 102. The person skilled in the art will however appreciate that other embodiments comprising more than two latches could be considered. In this case, it is preferable that the latches be equally distributed around the latching body 102 in order to distribute the pressure that can be applied to it but other arrangements could be considered. The person skilled in the art will also appreciate that corresponding lateral openings will have to be made in the unlatching tube 108 to receive the ends 120 of each latch.

Referring to FIGS. 2 and 3, the latching device 100 also comprises a tubular piston 122 slidably mounted around the latching body 102 proximate the operative ends 120 of the latches 116, 118 and securely to the unlatching tube 108. Thus, the piston 122 is able to move on the latching body 102 by following the movement of the unlatching tube 108.

In one embodiment, a split pin 124 is used to securely attach the piston 122 to the unlatching tube 108. The person skilled in the art will however appreciate that other attaching means may be considered.

The latching device 100 comprises a compression spring mechanism 126 mounted on the upper portion 106 of the latching body 102 and pressing the piston 122 towards the latches 116, 118 in order to maintain them in their deployed position so as to latch the latching device 100 in place and thereby allow a safe drilling operation.

When a pulling force is exerted on the unlatching tube 108 secured to the piston 122, as shown in FIG. 3, it compresses the spring mechanism 126 so as to prevent the piston 122 from pressing on the latches 116, 118 which then position themselves in their retracted position in order to allow hoisting up an element of the drilling device (not shown), as detailed hereinbelow.

In the illustrated embodiment, the spring mechanism 126 comprises a spring 128 mounted around the upper portion 106 of the latching body 102 which acts as a guide for the spring 128 and the piston 122, a retaining washer 130 and a retaining nut 132 longitudinally mounted to the latching body 102 to keep the spring 128 in compression against the piston 122. In the illustrated embodiment, the spring 128 is held in compression against the upper surface of the piston 122, this surface being a planar surface. This characteristic is advantageous since it allows to seat the spring 128 on a flat surface large enough to allow an increased reliability of the latching device 100 compared to the systems of the prior art and consequently an increased safety for the driller.

In an embodiment, the spring 128 is compressed between 10% and 25% from its natural rest position when the unlatching tube 108 extends in its low rest position. In another embodiment, the spring is compressed at 17% when the unlatching tube 108 extends in its low rest position.

The choice of the spring may be guided by the type of particular drilling one desires to do. For example, the spring can have a diameter of ¾ inch for the conventional BQ type boreholes (36.5 mm in diameter), up to a diameter of 4 inches for the conventional PQ type boreholes (85 mm in diameter).

The person skilled in the art will appreciate that other types of springs and other compression rates could be used depending on a specific application.

In an embodiment, the operative end 120 of each latch 116, 118 is particularly designed to facilitate the latching and unlatching operations of the latching device 100, whilst offering a high degree of reliability of the device.

In the embodiment shown in FIGS. 2 and 3, the operative end 120 of each latch comprises an inner contact surface 134 having a predetermined shape complementary to a corresponding lateral outer surface 136 of the piston 122 when the latches 116, 118 are extended in their deployed position.

In an embodiment, the inner contact surface 134 of the operative end 120 of each latch 116, 118 may comprise at least two portions extending at an angle comprised between 20 and 60 degrees with respect to a longitudinal axis of the outer tube 10 when the latches 116, 118 are extended in their deployed position.

In an embodiment, as illustrated, the two portions extend at 30 degrees with respect to the longitudinal axis of the outer tube 10 when the latches 116, 118 are extended in their deployed position.

In the embodiment shown in FIGS. 2 and 3, the operating extremity 120 of each latch 116, 118 also comprises an upper stop surface 138 having a predetermined shape complementary to a corresponding stop surface 140 of the internal shoulder 24 when the latches 116, 118 are extended in their deployed position.

As illustrated, each stop surface 140 of the internal shoulder 24 may comprise a planar surface perpendicular to a longitudinal axis of the outer tube 10.

Still referring to FIGS. 2 and 3, the operative end 120 of each latch 116, 118 may comprise a lateral outer contact surface 142 having a predetermined shape complementary to a corresponding lateral outer surface 144 of the outer tube 10 when the latches 116, 118 extend in their deployed position.

In an embodiment, the lateral outer contact surface 142 of the operative end 120 of each latch 116, 118 and each corresponding lateral outer surface 144 of the outer tube 10 comprise a cylindrical portion.

In an embodiment, as shown in FIGS. 2 and 3, the operative end 120 of each latch 116, 118 comprise a lower lateral outer surface 146 extending at a predetermined angle with respect to the unlatching tube 108 when the latches 116, 118 extend in their deployed position. The unlatching tube 108 thus pushes each latch 116, 118 in their retracted position by sliding in its high operating position against the lower lateral outer surface 146 of the operative end 120 of the corresponding latch 116, 118.

In an embodiment, the predetermined angle of each lower lateral outer surface 146 is comprised between 15 and 30 degrees. In another embodiment, this predetermined angle is 23 degrees.

In the illustrated embodiment, the latches 116, 118 are designed to be maintained in contact at all times with the piston 122, even when they are in their retracted position. The person skilled in the art will appreciate that other configurations may be considered.

In an embodiment, as illustrated, the latches 116, 118 are attached to the latching body 102 in an off-centered configuration with respect to the longitudinal axis thereof. In other words, the rotation axis of each latch is diametrically opposed with respect to the other on a symmetry axis perpendicular to the longitudinal axis of the latching body 102.

The person skilled in the art will appreciate that the proposed configuration may allow reducing the effort required to unlatch the latches and also reducing the travel distance needed to retract the latches.

In an embodiment, the piston 122 and each latch 116, 118 are made out of a very durable material in order to effectively withstand the forces that are applied to it. Heat-treated steel or alloyed steel, as is well known by a person skilled in the art, may be used. In one embodiment, the material used comprises hardened steel.

In an embodiment, as shown, an attachment head 200 is attached in the unlatching tube 108 on the side of an opening access 30 of the outer tube 10 to pull the unlatching tube 108 it its high activated position and release the latches 116, 118.

In another embodiment, the element of the drilling device which is hoisted (not shown) includes a core tube which allows a core to be obtained. Thus, when the driller wants to recover the core tube and hoist up the core, he sends a recovery unit down the borehole. This unit will dock itself at the tip of the attachment head 200 with the help of an overshot (not shown).

When the driller exerts a pulling force on the tip of the attachment head 200 which is linked to the unlatching tube 108, he is going to release the tension in the spring 128 by pulling on the piston 122, thereby releasing the latches 118. The unlatching tube 108 will first abut the latches 116, 118, then, by continuing its movement towards the driller, push the latches 116, 118 inside the unlatching tube 108 in their retracted position. Once the latching device 100 is unlatched, the driller will be able to hoist the core with the help of a cable, as well known in the art.

As previously mentioned, the latching device 100 allows performing a drilling operation when the device is latched, and also allows hoisting a core obtained during the drilling operation when the device is unlatched.

Furthermore, the latching device 100 can also be used for drilling boreholes oriented upwardly. Indeed, by offering a latching device with an increased reliability since it does not rely on the mere effect of gravity to latch the latches, the driller can now drill up without fear that the device will unlatch without warning, which is a great advantage.

The invention also proposes a drilling method for a borehole comprising placing a drilling device equipped with an outer tube where the borehole has to be drilled; providing a latching device as previously defined; attaching a drilling head to a lower end of the latching device; lowering the drilling head in the outer tube; latching the latching device inside the outer tube; and drilling the borehole using the drilling head.

According to an embodiment, the method further comprises using a core tube to obtain a sample core; exerting a pulling force on the unlatching tube of the latching device to unlatch the latching device from the outer tube; and hoisting up the sample core.

According to another embodiment, the pulling force exerted on the unlatching tube of the latching device is exerted using gripping means.

The latching device previously described is very advantageous since it allows increasing the reliability of the operations while actively participating in the driller's safety. Moreover, the person skilled in the art will appreciate that the release of the core barrel is facilitated.

The latching device as previously described may also be manufactured less expensively compared to the existing latching devices, and its maintenance is made easier since the breakage risks are greatly reduced.

Although the present invention was described with the help of specific embodiments, it is understood that several variations and modifications may be incorporated in said embodiments, and the present invention aims at covering such modifications, uses or adaptations of the present invention following generally the principles of the invention and including any variation of the present description, in accordance with the scope of the following claims.

The invention claimed is:

1. A latching device for a drilling device comprising an outer tube provided with an internal shoulder, said latching device comprising:

an elongated latching body mounted within the outer tube comprising a lower portion and an elongated upper portion;

an unlatching tube mounted within the outer tube around the latching body and configured to slide between a high operating position and a low rest position, said unlatching tube comprising at least two elongated lateral openings distributed therearound;

at least two latches, each latch being pivotably mounted on the latching body and comprising an operative end, each latch configured to pivot between a deployed position, wherein the operative end of the latch projects outside the unlatching tube through one of the corresponding openings to abut under the internal shoulder of the outer tube thereby latching the latching body to the outer tube and preventing removal of the latching body, and a retracted position, wherein the latch is retracted near the latching body in order to unlatch the latching body from the outer tube;

a tubular piston slidably mounted around the latching body proximal to the operative ends of the latches and secured to the unlatching tube, wherein the at least two latches are configured to accept the tubular piston between the operative end of each latch; and a compression spring mechanism mounted on the upper portion of the latching body and configured to press the piston towards the at least two latches thereby maintaining the latches in the deployed position in order to allow a drilling operation, wherein a pulling force exerted on the unlatching tube secured to the piston compresses the spring mechanism so as to prevent the piston from pushing against the at least two latches thereby allowing the at least two latches to move to the retracted position in order to allow an element to be hoisted up from the drilling device.

2. The latching device according to claim 1, wherein each opening has a predetermined width for receiving the operative end of one of the corresponding latches.

3. The latching device according to claim 1, wherein the outer tube comprises a tubular element designed to be buried in a borehole, an adaptor sleeve mounted on the tubular element and a locking sleeve mounted on the adaptor sleeve.

4. The latching device according to claim 3, wherein the internal shoulder is defined by an end of the locking sleeve extending inside the adaptor sleeve.

5. The latching device according to claim 1, wherein the operative end of each latch comprises an inner contact surface having a predetermined shape complementary to a corresponding lateral outer surface of the piston when the latches extend in their deployed position.

6. The latching device according to claim 5, wherein the inner contact surface of the operative end of each latch comprises at least two portions extending at an angle comprised between 20 and 60 degrees with respect to a longitudinal axis of the outer tube when the latches extend in their deployed position.

7. The latching device according to claim 6, wherein the at least two portions extend at a 30 degree angle with respect to the longitudinal axis of the outer tube when the latches extend in their deployed position.

8. The latching device according to claim 1, wherein the operative end of each latch comprises an upper stop surface having a predetermined shape complementary to a corresponding stop surface of the internal shoulder when the latches extend in their deployed position.

9. The latching device according to claim 8, wherein each stop surface of the internal shoulder comprises a planar surface perpendicular to a longitudinal axis of the outer tube.

10. The latching device according to claim 1, wherein the operative end of each latch comprises a lateral outer contact surface having a predetermined shape complementary to a corresponding lateral outer surface of the outer tube when the latches extend in their deployed position.

11. The latching device according to claim 10, wherein the lateral outer contact surface of the operative end of each latch and each corresponding lateral outer surface of the outer tube comprise a cylindrical portion.

12. The latching device according to claim 1, wherein the operative end of each latch comprises a lower lateral outer surface extending at a predetermined angle with respect to the unlatching tube when the latches extend in their deployed position, wherein the unlatching tube is configured to push each latch to the retracted position when the unlatching tube is in the high operating position by pushing against the lower lateral outer surface of the operative end of the corresponding latch.

13. The latching device according to claim 12, wherein the predetermined angle of each lower lateral outer surface is comprised between 15 and 30 degrees.

14. A method for performing a drilling operation comprising:

providing the latching device for the drilling device according to claim 1, latching the drilling device via the latching device thereby allowing for a borehole to be drilled, and unlatching the drilling device via the latching device thereby allowing a core obtained during the drilling operation to be hoisted up through the borehole.

15. A method for drilling a borehole comprising:

installing a drilling apparatus provided with an outer tube at a location where the borehole is to be drilled;

providing a latching device as defined in claim 1;

attaching a drilling head to a lower end of said latching device;

lowering the drilling head into the outer tube;

latching the latching device inside the outer tube; and drilling the borehole using the drilling head.

16. The latching device according to claim 1, wherein each latch is mounted in a diametrically opposed configuration on the latching body.

17. The latching device according to claim 1, wherein the at least two latches are configured to maintain a gap between the operative end of each latch, said gap adapted to accept the tubular piston therein.

* * * * *